US011230453B2

(12) United States Patent
De Matteis

(10) Patent No.: US 11,230,453 B2
(45) Date of Patent: Jan. 25, 2022

(54) ROLLER FOR CONVEYING A WEB OR SHEET OF PAPER IN PAPER CONVERTING MACHINES AND CONVEYING METHOD THUS OBTAINED

(75) Inventor: Alessandro De Matteis, Capraia Isola (IT)

(73) Assignee: KÖRBER TISSUE FOLD S.R.L., Porcari (IT)

( * ) Notice: Subject to any disclaimer, the term of this patent is extended or adjusted under 35 U.S.C. 154(b) by 536 days.

(21) Appl. No.: 13/137,665

(22) Filed: Sep. 1, 2011

(65) Prior Publication Data

US 2012/0065045 A1 Mar. 15, 2012

Related U.S. Application Data

(63) Continuation-in-part of application No. 10/779,940, filed on Feb. 17, 2004, now abandoned.

(30) Foreign Application Priority Data

Feb. 18, 2003 (EP) ..... 03425091

(51) Int. Cl.
*B31F 1/10* (2006.01)
*B65H 27/00* (2006.01)
*B65H 45/24* (2006.01)

(52) U.S. Cl.
CPC ..... *B65H 27/00* (2013.01); *B65H 45/24* (2013.01); *B65H 2406/3614* (2013.01)

(58) Field of Classification Search
CPC .. D21F 3/10; D21F 3/02; B65H 27/00; B65H 2406/3614; B65H 20/12; B65H 45/24; B65H 45/20; B65H 2406/36; B65H 2406/364; B65H 2406/365; B65H 29/243; B65H 29/26; B65H 45/28
USPC ..... 493/442; 226/95; 162/306, 360.2, 365, 162/368, 369, 370, 371, 372, 199
See application file for complete search history.

(56) References Cited

U.S. PATENT DOCUMENTS 1,120,432 A * 12/1914 Atkins ..... D21F 3/10 162/369
1,761,517 A * 6/1930 Christman ..... 270/39.09
1,832,974 A * 11/1931 Farnsworth ..... D21F 3/10 162/371
2,274,641 A * 3/1942 Abbott ..... D21F 3/10 15/DIG. 7
2,900,024 A * 8/1959 Holcroft ..... D21F 3/10 162/371
3,037,557 A * 6/1962 Faeber et al. ..... 162/370
(Continued)

*Primary Examiner* — Robert F Long
*Assistant Examiner* — Eduardo R Ferrero
(74) *Attorney, Agent, or Firm* — Ladas & Parry LLP; Malcolm J. MacDonald

(57) ABSTRACT

An improved conveying roller for a web or a sheet in a paper converting machine comprises a first cylindrical tubular body having a plurality of radial holes arranged in substantially longitudinal rows, and a second fixed tubular body arranged coxially within the first cylindrical tubular body. The first cylindrical tubular body is capable of rotation relative to the second fixed tubular body. Slidable sealing elements are positioned between the first cylindrical body and the second fixed tubular body to define at least one suction or vacuum chamber. The chamber is suitable for being brought selectively in communication with at least one row of the radial holes during the relative rotation of the bodies.

9 Claims, 3 Drawing Sheets

(56) References Cited

U.S. PATENT DOCUMENTS 3,587,962 A * 6/1971 Herzhoff ..... 226/95
3,902,960 A * 9/1975 Zentner et al. ..... 162/199
4,016,032 A * 4/1977 Kankaanpaa ..... D21F 2/00 162/305
4,070,014 A * 1/1978 Takahashi ..... 270/39.09
4,163,548 A * 8/1979 Nystrand ..... 270/39.07
4,345,752 A * 8/1982 Nakamura ..... B65H 3/10 271/104
4,714,523 A * 12/1987 Sawyer et al. ..... 162/371
4,849,062 A * 7/1989 Jennet ..... B29D 99/0089 156/197
4,917,665 A * 4/1990 Couturier ..... B65H 45/24 493/359
5,088,707 A * 2/1992 Stemmier ..... B65H 45/24 270/32
5,094,437 A * 3/1992 Hauschild ..... B65H 45/101 270/39.09
5,147,273 A * 9/1992 Rottmann ..... B65H 45/24 270/39.06
5,230,456 A * 7/1993 Germann ..... B41F 13/02 226/194
5,358,163 A * 10/1994 Naka ..... B65H 20/12 226/95
5,580,424 A * 12/1996 Snellman ..... D21F 3/10 162/368
5,746,891 A * 5/1998 Withers ..... 162/371
6,095,513 A * 8/2000 Wright ..... B65H 3/10 271/104
6,105,897 A * 8/2000 Cramer ..... B65H 18/20 242/541
6,213,927 B1 * 4/2001 De Matteis ..... B65H 45/24 493/356
6,228,014 B1 * 5/2001 De Matteis et al. ..... 493/424
6,328,194 B1 * 12/2001 Meschenmoser ..... 226/95
6,340,155 B1 * 1/2002 Madsen ..... B41J 11/0025 198/471.1
6,358,370 B1 * 3/2002 Huttunen ..... 162/363
6,395,137 B1 * 5/2002 Snellman ..... 162/371
6,431,038 B2 * 8/2002 Couturier ..... B26D 5/02 493/353
6,436,241 B1 * 8/2002 Persson et al. ..... 162/371
6,488,194 B1 * 12/2002 Couturier ..... 226/95
6,585,139 B1 * 7/2003 Holtmann et al. ..... 226/95
7,306,554 B2 * 12/2007 Couturier ..... B65H 45/24 270/39.01
7,367,264 B2 * 5/2008 Beaudry ..... 101/409
8,057,375 B2 * 11/2011 Butterworth ..... B65H 45/24 270/39.05
2002/0140151 A1 * 10/2002 Couturier ..... B65H 23/245 270/58.07
2004/0250706 A1 * 12/2004 De Matteis ..... B65H 5/226 100/121

* cited by examiner

ROLLER FOR CONVEYING A WEB OR SHEET OF PAPER IN PAPER CONVERTING MACHINES AND CONVEYING METHOD THUS OBTAINED

This application is a continuation-in-part of application Ser. No. 10/779,940, filed Feb. 17, 2004 now abandoned.

FIELD OF THE INVENTION

The present invention relates to the field of machines for converting paper and similar products, and in particular it relates to a paper conveying roller for machines working in this field such as in particular winding, rewinding, interfolding machines.

In particular, the invention relates to a paper conveying roller having circumferentially a plurality of holes which, connected to a vacuum system, allow the sheet or web of paper to adhere on their surface.

BACKGROUND OF THE INVENTION

As known, many machines used in the paper converting field, for example rewinding and interfolding machines, are equipped on the surface of their rollers with systems for capturing the web or the sheet of processed paper, in certain operative phases, in order to cause the paper to follow a predetermined path.

In particular, such systems are used to provide the main operations of cutting the paper, of transferring it quickly from a roller to another, of final folding the paper same. To this end, the machines are normally equipped either with mechanical clamps or with pneumatic suction means.

In the latter case, the air suction systems, owing to a certain vacuum grade created within the rollers, cause the processed paper to adhere on the roller surface by means of rows of suction holes.

In more detail, as shown diagrammatically in FIGS. 1 and 2, in a paper conveying roller 101, of known art, the vacuum is transmitted through a plurality of longitudinal channels 102 into roller 101, causing the paper 120 to adhere selectively to the roller surface same by means of a plurality of holes 103. Normally, holes 103 are arranged according to longitudinal rows with respect to axis 104 of the cylinder (transversal with respect to the paper) since the vacuum is made selectively by distributor means. This causes a division of the roller surface into paper suction fields, i.e. where the rows of holes are enabled for suction, and into fields where the processed paper is instead freed from the roller for being for example transferred onto another roller or folded, i.e. the respective rows of holes are not enabled for suction.

In particular, the paper conveying roller is normally coupled, at an end thereof, to a bell-shaped vacuum distributor element 110 to it co-axial but whose rotation is impeded by means of a suspension on ball bearings. The vacuum distributor 110 is equipped with an inlet 111 connected to the suction system of the machine and communicating with a curved opening 112 determined on the distributor same. More in detail, the curved opening 112 extends for a certain angle and, during the rotation of the roller about its own axis, selectively communicates with longitudinal channels 102 and then with the respective rows of holes 103. This way, a portion of roller surface (hatched area in FIG. 1) is obtained in which the sheet or the web of paper is captured by suction and adheres on the roller surface.

With this system, channels 102 are at atmospheric pressure except from when they are in communication with the vacuum distributor. This causes, however, the row of holes 103, which is enabled to suction by alignment with curved opening 112, to start the suction of the sheet on the roller surface 101 only after that the air present in the respective longitudinal channel 102 has been removed. Therefore, there is a delay between the beginning of the suction in channel 102 and the moment where the portion of roller surface located at hole row 103 can actually start the suction of the paper, owing to the vacuum inertia for the presence of air channel 102 and the propagation time of the vacuum for all the row of holes length. Furthermore, as soon as channel 102 is not more enabled for suction, even if there is a delay of the vacuum to disappear, then, in any case, the vacuum is lost and the channel returns to the atmospheric pressure.

A not efficient suction by the holes, on the other hand, can affect the successive operations of the machine causing paper jamming and stop of production.

In any case, the maximum air flow rate is limited.

In order to limit this drawback it is therefore necessary: to limit the length of the roller and then the volume of the chambers in it; this causes a subsequent limitation in the maximum width of the paper that can be processed and then reduces productivity of the machines that have such rollers; starting/stopping the suction of the air channel with a vacuum advance, so that the suction in all the holes starts/stops at a predetermined moment; with a vacuum advance, it is necessary to change the vacuum timing as varies the speed of operation of the machine; working with a high vacuum grade for reducing the time necessary for a row of suction holes to be fully operative.

As described in U.S. Pat. No. 4,207,998, paper dragging rollers also exist formed by a fixed cylinder that form a longitudinal chamber, about which a concentric roller rotates formed by a inner stiff tubular shell having a plurality of holes, and an outer resilient tubular shell, having a plurality of deformable holes. When contacting the paper the deformable holes are open and bring into communication the paper with the holes of the inner shell and the suction chamber, preventing the roller from sliding with respect to the paper. The sealing ability of the holes, however is limited to the contact with a web of paper and with a certain pressure, whereby this type of roller is unsuitable for applications with sheets of paper. Furthermore, it is suitable only for narrow fields of suction.

SUMMARY OF THE INVENTION

It is an object of the present invention to provide a folding unit comprising a folding roller equipped with suction points for conveying a sheet of paper in folding machines, which allows to provide a high production rate even with a low vacuum grade and thus less expensive with respect to the prior art folding units.

It is another object of the present invention to provide an interfolding machine having such a folding unit for increasing productivity and flexibility of the machine on which it is mounted, in order to work sheets of paper of different type and wide enough without affecting the efficiency of the process.

It is a particular object of the present invention to provide an interfolding machine having two folding rollers that can efficiently and precisely pick up a sheet from a point of contact between the two rollers up to a folding point.

It is still another object of the invention to provide a sheet folding method for conveying sheets of paper that uses this sheet folding unit.

These and other objects are achieved by a sheet folding unit comprising two conveying rollers and two respective folding rollers working in cooperation with said conveying rollers, said folding rollers comprising a suction system arranged to capture from said conveying rollers a sheet of paper and to bring the sheet up to a point of contact between said two folding rollers, said suction system further arranged for causing said sheet to pass from one folding roller to the other folding roller and to follow the other folding roller up to a folding point by comprising in said folding roller:

- a first cylindrical tubular body, equipped with a plurality of radial holes arranged according to substantially longitudinal rows,
- a second tubular body within said first tubular body that extends for all length of said first tubular body and is always connected to a vacuum source, whereby said second tubular body is always under vacuum,
- an interposition means integral to said second tubular body and arranged between said second tubular body and said first tubular body for defining a suction chamber between said second tubular body and said first tubular body, such that by the rotation of said first tubular body said interposition means can selectively connect said suction chamber with at least one row of holes at determined angular positions of said first tubular body to provide a suction effect on the sheet only at said positions,
- wherein said interposition means is arranged between said second tubular body and said first tubular body such that said angular positions are located between said point of contact and said folding point.

The fact that a determined vacuum grade is steadily maintained allows to enable directly for suction the holes located in the portion of surface overlapping the suction chamber in order to achieve a precise and strong suction of the longitudinal rows.

Moreover, it is possible to provide folding rollers of much more length and then of increasing the flexibility and productivity of the machines that use them.

Advantageously, the sliding sealing capability is obtained with two radial boards, between which at least one opening is present, which extends between the first and the second tubular body for all the length of the roller in order to define the suction chamber.

Preferably, to increase the outlet speed of the air through the suction chamber, a plurality is provided of apertures arranged longitudinally along the second cylindrical tubular body and within the portion thereof defined by the radial boards.

In particular, to assure a high sealing capability, the ends which in the suction chamber contact the inner surface of the first body can provide plastic inserts, for example of polymeric resin, which slide on the smooth inner surface of the first tubular body.

Preferably, the sealing capability of the suction chamber is achieved forcing elastically the radial boards against the inner surface of the first cylindrical tubular body. This way, the necessary side sealing conditions of the suction chamber are guaranteed without that the radial boards effect a high resistance against the relative rotation of the two cylindrical tubular bodies.

In a preferred embodiment each radial board can comprise a fixed portion, forming a guide arranged longitudinally with respect to the conveying roller, within which a bar can slide radially forced elastically against the inner surface of the first cylindrical tubular body.

According to a particular aspect of the invention a paper converting machine, such as a rewinding machine, a winder or an interfolding machine, comprises at least one paper conveying roller as above described.

Advantageously, in order to capture from said conveying rollers a sheet of paper and to bring the sheet up to a point of contact between said two folding rollers, the sheet folding unit can comprise a bell-shaped vacuum distributor arranged at an end of said folding roller and selectively communicating with the rotation of said first tubular body with longitudinal channels arranged in said first tubular body and with a respective row of holes.

According to another aspect of the invention a sheet folding method comprises:

- conveying a sheet of paper from a conveying roller to a folding roller of a couple of folding rollers, providing in said folding roller a suction system arranged to capture from said conveying rollers a sheet of paper and to bring the sheet up to a point of contact between said folding rollers, said suction system further arranged for causing said sheet to pass from one folding roller to the other folding roller and to follow the other folding roller up to a folding point by comprising in said folding roller,
- a first tubular body capable of rotating about an axis of rotation, said first tubular body having a plurality of radial holes arranged according to substantially longitudinal rows,
- a second tubular body within said first tubular body that extends for all length of said first tubular body and is always connected to said suction system, whereby said second tubular body is always under vacuum,
- an interposition means integral to said second tubular body and arranged between said second tubular body and said first tubular body for defining a suction chamber between said second tubular body and said first tubular body, such that by the rotation of said first tubular body said interposition means can selectively connect said suction chamber with a row of holes at determined angular positions of said first tubular body to provide a suction effect on the sheet only at said positions,
- wherein said interposition means is arranged between said second tubular body and said first tubular body such that said angular positions are located between said point of contact and said folding point;
- wherein said step of causing said sheet to pass from one folding roller to the other folding roller up to a folding point where said sheet is folded is carried out by said row of holes of said first tubular body at said angular positions.

Advantageously, said step of capturing from said conveying rollers a sheet of paper and to bring the sheet up to a point of contact between said folding rollers, comprises providing a bell-shaped vacuum distributor at an end of said folding roller and selectively communicating a vacuum source, with the rotation of said first tubular body, with longitudinal channels arranged in said first tubular body and with a respective row of holes.

BRIEF DESCRIPTION OF THE DRAWINGS

In the drawings, FIGS. 1 and 2 already commented in the introductory part show the following.

Figure 3:
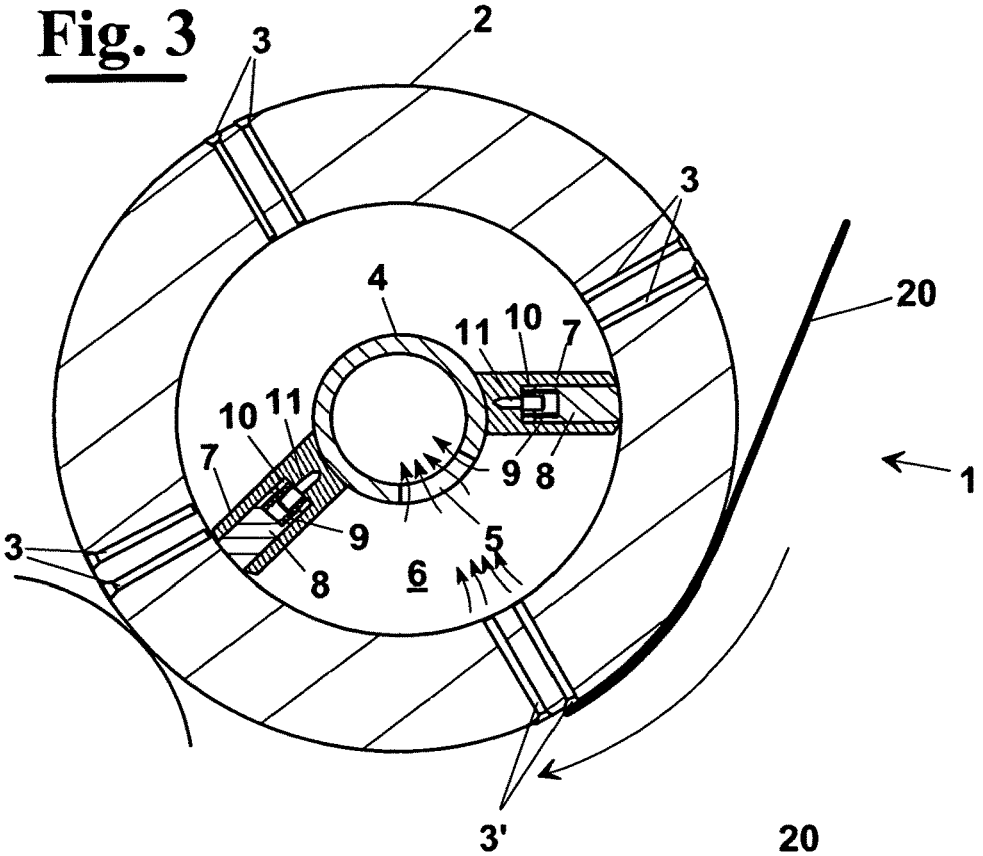
Figure 4:
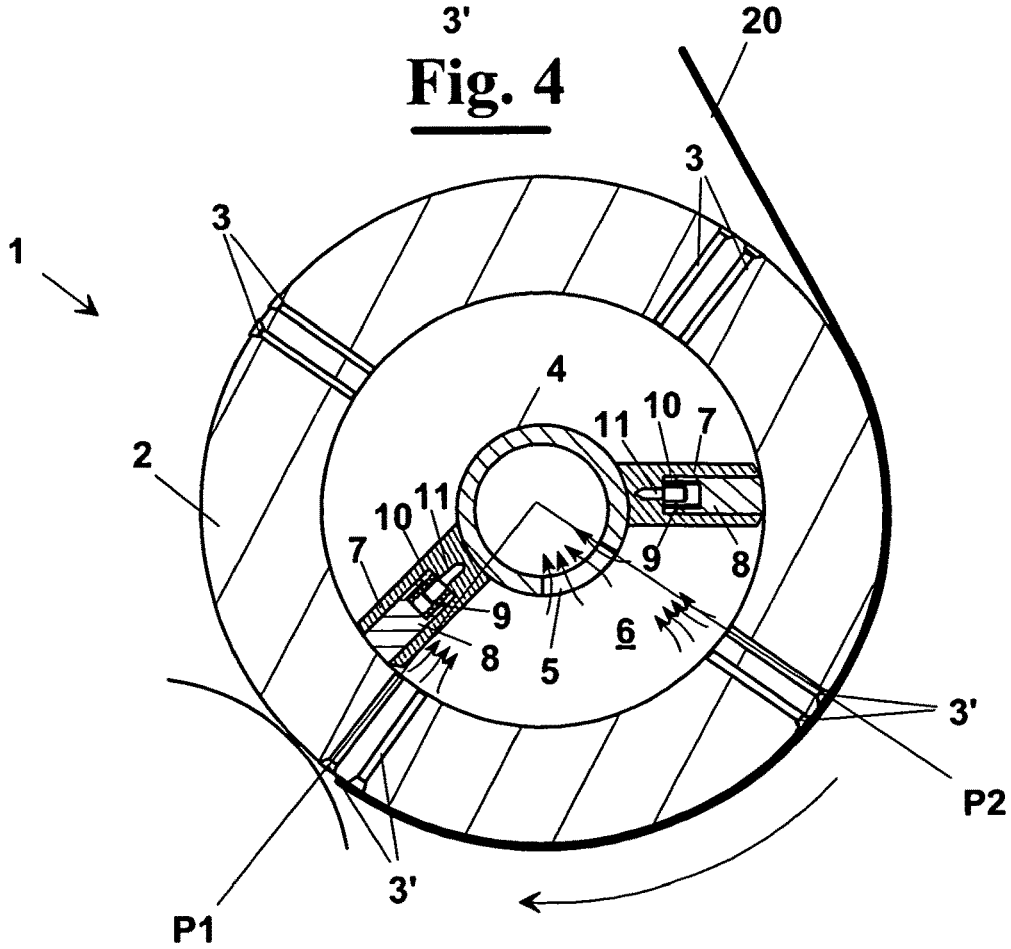
Figure 5:
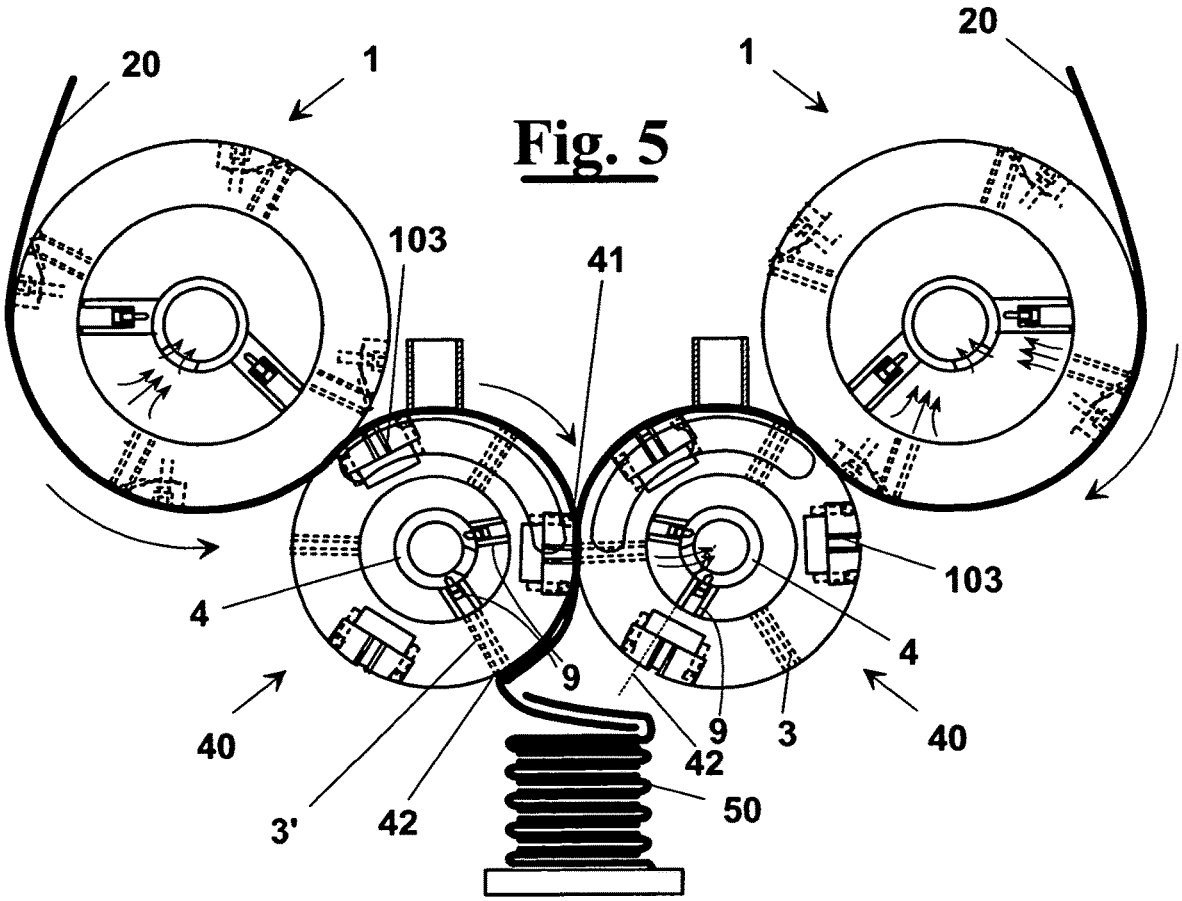

Further characteristics and the advantages of the roller according to the present invention, equipped with suction points for conveying a web or sheet of paper in paper converting machines, will be made clearer with the following description of an embodiment thereof exemplifying but not limitative, with reference to the attached drawings wherein:

FIGS. 3 and 4 show a cross sectional view of a paper conveying roller for paper converting machines, according to the present invention, in two relative different positions between the first and the second cylindrical tubular body, wherein said roller has a suction system as used in the sheet folding unit like that of FIG. 5;

FIG. 5 shows a cross sectional view of a sheet folding unit of an interfolding machine that has conveying rollers according to the invention.

DESCRIPTION OF THE PREFERRED EMBODIMENTS

In FIGS. 3 and 4, a cross sectional view is shown of a roller 1 used for conveying a web or sheet of paper 20 for a sheet folding unit like that of FIG. 5.

The roller 1 comprises a first outer cylindrical tubular body 2, equipped with a plurality of radial holes 3 arranged according to substantially longitudinal rows, capable of rotating with respect to a second inner fixed body 4, co-axial to the former and connected to a suction system not shown. The second body 4, which as shown in the embodiments of FIGS. 3 and 4 has tubular cylindrical geometry like first body 2, has a plurality of apertures 5 and two radial boards 7 at opposite sides with respect to apertures 5.

The inner surface of first cylindrical tubular body 2, radial boards 7 and the external surface of second tubular body 4 define a suction chamber 6 that, during the relative rotation of the two bodies, brings selectively in communication some rows of holes 3 of first cylindrical tubular body 2 with the apertures 5 of second tubular body 4 and then with the suction system of the machine. Therefore, a web or sheet of paper 20 adheres to the external surface of first body 2 only in the portion P1P2 of the surface set between the rows of holes 3' that communicate with the suction chamber (FIG. 4).

The apertures 5 made on the surface of second tubular body 4 are arranged longitudinally and are enough to allow a quick outlet of the air present in holes 3' that in turn overlap to the suction chamber 6. This is possible also because chamber 6 is fixedly kept at a determined vacuum grade.

In particular, radial boards 7, between which the apertures 5 extend, are arranged radially for all the length of second cylindrical tubular body 4 and are have high sealing capability of the suction chamber from the remaining space comprised between bodies 2 and 4. This result is obtained with radial boards having a fixed portion 10, integral to second inner tubular body 4 and forming a longitudinal channel, and a movable portion 7 that engages with fixed portion 10 and pushes elastically against the inner surface of first tubular body 2 urged by springs 9. Springs 9 can be located, as in the case of FIGS. 3 and 4, about pins 11 which are constrained in a housing within fixed portion 10.

This way, it is possible to define with high precision the portion of the roller surface 1 enabled for the suction of the paper and to make easier possible cutting operations, which can be made between two adjacent rows of holes 3.

This is, for example, effected in case of a sheet folding unit of an interfolding unit shown diagrammatically in FIG. 5. In particular, conveying rollers 1 are provided as above described that work in cooperation with folding rollers 40. The unit works for example in the way described in EP0982255 or in EP0982256 in the name of the same applicant.

Figure 1:
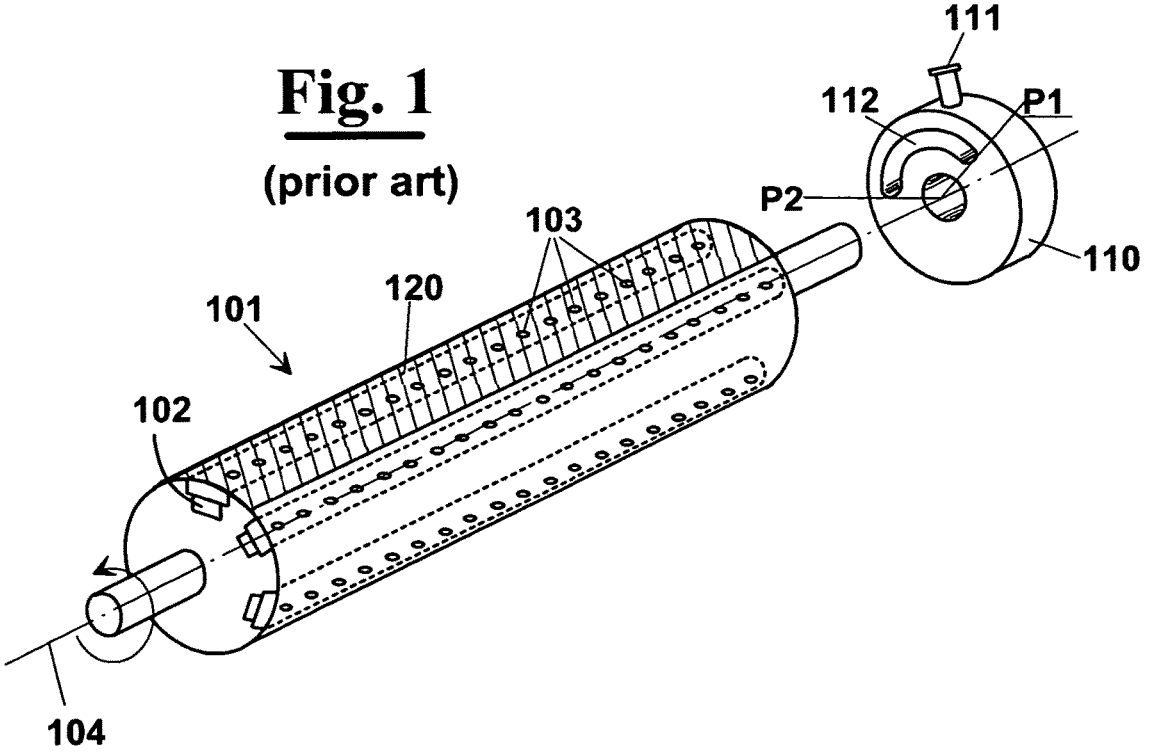
Fig. 1 (prior art)
FIG. 1 is a perspective view of a paper conveying roller for paper converting machines and of the vacuum distributor to it associated, as known in the art.
Figure 2:
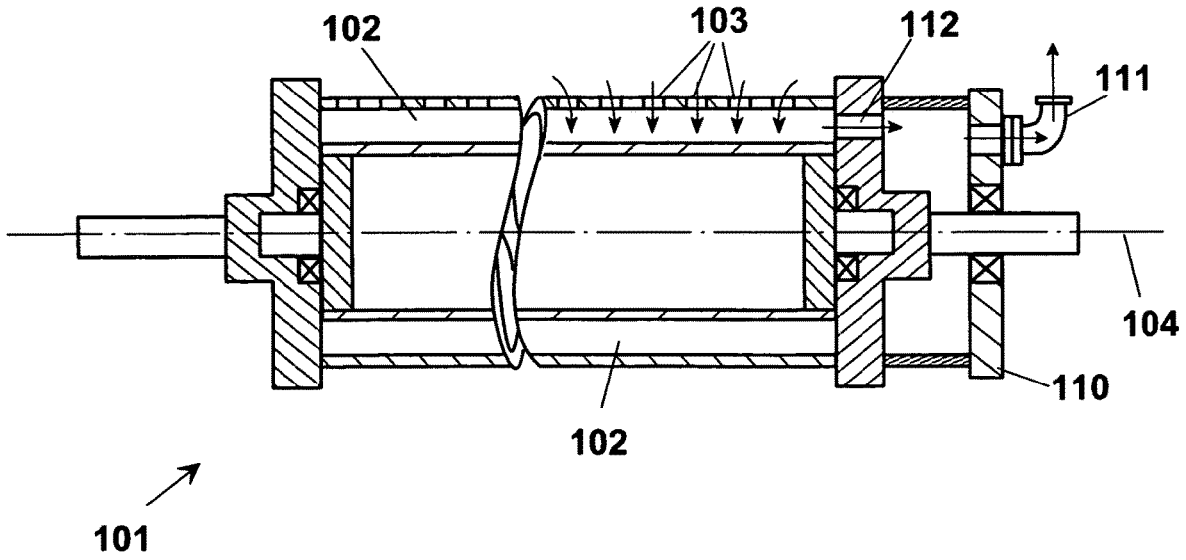
Fig. 2 (prior art)
FIG. 2 shows a longitudinal cross section of a conveying roller according to the prior art coupled to a vacuum distributor.

More precisely, in a folding unit like FIG. 5, sheets 20 coming from conveying rollers 1 are captured by suction rows 103 (similar to FIG. 2) of respective folding rollers 40 and are then dragged up to the point of contact 41 between folding rollers 40.

Therefore, contemporaneously, there are two sets of sheets coming from the left and from the right, which are shifted from each other. Suction rows 103 of folding rollers 40 capture the head of each sheet 1 and then they become inactive at point of contact 41.

Suction rows 3' become active at point of contact 41 and then become inactive at folding point 42.

This way a sheet 20 coming from one folding roller 40 (in FIG. 5 coming from left folding roller) is captured at point of contact 41 by the rows 3' of the other folding roller 40.

In the meantime, a sheet 20 that was coming from the other folding roller 40 (right) and that had been captured at point of contact 41 has been brought up to folding point 42 by the other (left) folding roller 40.

So, at folding point 42, the sheet is free to fold and form the stack 50.

In particular, at contact point 42, there are two sheets overlapping, and the folding unit has to capture both.

Therefore, suction row 103 is enough for capturing the sheet from the conveying roller 1 and to bring it to contact point 41. Instead, such a suction row 103 would be not precise and is not strong enough to pick up exactly at contact point 41 two sheets together, and to bring them together up to folding point 42.

According to the invention, the suction force of suction rows 3' is suddenly strong, and precise, because it is always under vacuum, and as soon as a suction row 3' is at suction chamber, it is immediately active with a strong suction force, and can capture two overlapping sheets.

With reference to the particular and not limiting embodiment of FIG. 5, differently from rollers 1, rollers 40 have six couples of rows, where three couples of rows of holes spaced 120° capture the end of a sheet, and other three couples of rows of holes spaced 120°, shifted 60° with respect to the former, capture through the central portions of a sheet, the end of a second overlapped sheet and ready for being interfolded. Therefore, the first three couples of holes are enabled for suction between two consecutive cuts, for a sector between the point of contact of rollers 1 with rollers 40 up to the contact between the two opposite rollers 1, whereas the other three couples of holes must be enabled for suction between the contact between the two rollers 40 and the point where the fold is made.

Therefore, rollers 40 are shown in FIG. 5 having a "mixed" structure as a combination of a roller of prior art and a roller 1 according to the invention. More in detail:

the sheet is captured by roller 1 up to the point of contact between two rollers 40 by means of a traditional suction system, namely a first suction system, with suction channel and bell-shaped vacuum distributor; in fact, for capturing and holding the sheet a light vacuum grade and a not high angular precision are enough and this system is sufficient;

the passage of a sheet from an interfolding roller 40 to the other is made with a second suction system according to the invention, since higher angular precision and higher vacuum in suction are required.

Obviously, a roller can be made that enables to suction three couples of rows of holes all with a system according to the invention. For example, the inner second body may have three radial boards, forming three chambers, one not enabled to suction and two enabled to suction with a different vacuum grade.

The present invention is applicable at a desired interfolding, machine which uses a sheet folding unit according to the invention.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

What is claimed is:

1. A sheet folding unit comprising:

two conveying rollers and two respective folding rollers working in cooperation with said conveying rollers, each of the folding rollers comprising first rows of holes connected to a first suction system by first suction channels and a first vacuum distributor, said first suction system having a first suction force, said first rows of holes arranged to capture from said conveying rollers a sheet of paper and to bring the sheet up to a point of contact between said two folding rollers, and each of the folding rollers comprising second rows of holes connected to a second suction system having a second suction force, wherein the second suction force of the second suction system is greater than the first suction force of the first suction system, said second rows of holes arranged for causing said sheet to pass from one folding roller to the other folding roller and to follow the other folding roller up to a folding point, each of the conveying rollers comprising a conveying system arranged for conveying said sheet to said point of contact and to release it to one of said folding rollers at one row of holes of said first rows of holes, said folding rollers further comprising:

a first tubular body capable of rotating about an axis of rotation, said first tubular body having a plurality of couples of neighboring parallel rows of radial holes of said second rows of holes, a second tubular body within said first tubular body that extends for all length of said first tubular body and is always connected to a vacuum source, whereby said second tubular body is always under vacuum, an interposition means integral to said second tubular body and arranged between said second tubular body and said first tubular body for defining a suction chamber between said second tubular body and said first tubular body, said interposition means arranged in such a way that by the rotation of said first tubular body said interposition means selectively causes said suction chamber to connect with one row of holes at a time of said couples of neighboring parallel rows of radial holes of said second rows of holes at determined angular positions of said first tubular body and to provide the second suction force on a sheet captured by one row of holes of said first rows of holes and to cause said sheet to pass from one folding roller to the other folding roller and to follow the other folding roller between said positions up to said folding point.

2. A sheet folding unit according to claim 1, wherein said interposition means comprises sealing elements sliding against an inner surface of said first tubular body.

3. A sheet folding unit according to claim 2, wherein said sliding sealing elements are forced elastically against said inner surface of said first tubular body.

4. A sheet folding unit according to claim 1, wherein said interposition means provides two radial boards that radially extend from said second tubular body up to said first tubular body for all the length of said first and second tubular bodies to define said suction chamber, between said radial boards at least one opening being provided that brings in communication said chamber with an inner space within said second tubular body that in turn is connected to said vacuum source.

5. A sheet folding unit according to claim 4, wherein there is provided a plurality of apertures arranged longitudinally along said second cylindrical tubular body and within the portion thereof defined by said radial boards in said chamber.

6. A sheet folding unit according to claim 4, wherein each radial board comprises a fixed portion, forming a guide arranged longitudinally with respect to the conveying roller, within which a bar can slide radially forced elastically against the inner surface of the first cylindrical tubular body forming a sliding element.

7. A sheet folding unit according to claim 4, wherein said first suction system, in order to capture from said conveying rollers a sheet of paper and to bring the sheet up to a point of contact between said two folding rollers, comprise a bell-shaped vacuum distributor arranged at an end of said folding roller and selectively communicating with the rotation of said first tubular body with longitudinal channels arranged in said first tubular body and with a respective row of holes of said first rows of holes.

8. A method of folding a sheet, said method comprising:

conveying a sheet of paper from a conveying roller to a folding roller of a couple of folding rollers, each of the folding rollers comprising first rows of holes connected to a first suction system by first suction channels and a first vacuum distributor, said first suction system having a first suction force, wherein said first rows of holes are arranged to capture from said conveying rollers a sheet of paper and to bring the sheet up to a point of contact between said folding rollers, and each of the folding rollers comprising second rows of holes connected to a second suction system having a second suction force, wherein the second suction force of the second suction system is greater than the first suction force of the first suction system, said second rows of holes being arranged to cause said sheet to pass from one folding roller to the other folding roller and to follow the other folding roller up to a folding point, each of the conveying rollers comprising a conveying system arranged for conveying said sheet to and to release it to one of said folding rollers at one row of holes of said first rows of holes, said folding rollers further comprising:

a first tubular body capable of rotating about an axis of rotation, said first tubular body having a plurality of couples of neighboring parallel rows of radial holes of said second rows of holes, a second tubular body within said first tubular body that extends for all length of said first tubular body and is always connected to a vacuum source, whereby said second tubular body is always under vacuum, an interposition means integral to said second tubular body and arranged between said second tubular body and said first tubular body for defining a suction chamber between said second tubular body and said first tubular body, wherein said interposition means is arranged between said second tubular body and said first tubular body in such a way that said angular positions are located between said point of contact and said folding point;

wherein said interposition means arranged in such a way that by the rotation of said first tubular body said interposition means selectively causes said suction chamber to connect a row of holes at a time of said couples of neighboring parallel rows of radial holes of said second rows of holes at determined angular positions of said first tubular body and to provide the second suction force on a sheet captured by one row of holes of said first rows of holes and to cause said sheet to pass from one folding roller to the other folding roller and to follow the other folding roller between said positions up to said folding point.

9. A method according to claim 8, wherein said step of providing in said folding roller a first suction system arranged to capture from said conveying rollers a sheet of paper and to bring the sheet up to a point of contact between said folding rollers, comprises providing a bell-shaped vacuum distributor at an end of each of said folding rollers and selectively communicating with a vacuum source, by the rotation of said first tubular body, with longitudinal channels arranged in said first tubular body and with a respective couple of rows of holes of said first rows of holes.

* * * * *